US006527232B2

(12) United States Patent
Robertson et al.

(10) Patent No.: US 6,527,232 B2
(45) Date of Patent: Mar. 4, 2003

(54) BRACKET

(75) Inventors: Jeffrey S. Robertson, Canton, GA (US); Noel LeCher, Kennesaw, GA (US)

(73) Assignee: PlayNation Play Systems, Inc., Kennesaw, GA (US)

( * ) Notice: Subject to any disclaimer, the term of this patent is extended or adjusted under 35 U.S.C. 154(b) by 0 days.

(21) Appl. No.: 09/778,642

(22) Filed: Feb. 7, 2001

(65) Prior Publication Data

US 2002/0155784 A1 Oct. 24, 2002

Related U.S. Application Data

(60) Provisional application No. 60/229,623, filed on Aug. 31, 2000.

(51) Int. Cl.[7] ..... E04D 13/72; A63G 9/00

(52) U.S. Cl. ..... 248/48.2; 472/118

(58) Field of Search ..... 446/476, 85; 248/48.2; D8/354; 472/118

(56) References Cited

U.S. PATENT DOCUMENTS

| | | | | |
|---|---|---|---|---|
| D248,274 | S | * | 6/1978 | Kingston et al. ..... D8/354 |
| D265,051 | S | * | 6/1982 | Hentzschel et al. ..... D8/354 |
| 4,966,309 | A | | 10/1990 | Baer |
| 5,364,312 | A | | 11/1994 | Cunard et al. |

* cited by examiner

*Primary Examiner*—Derris H. Banks
*Assistant Examiner*—Faye Francis
(74) *Attorney, Agent, or Firm*—Troutman Sanders LLP; Ryan A. Schneider

(57) ABSTRACT

The present invention is an A-frame bracket having a rectangular top, and two rectangular side walls that each extend at an angle downwardly from the rectangular top, wherein each side wall has an integrally formed flange forming an "L"-shaped wall for receiving wooden legs that form an A-frame.

22 Claims, 1 Drawing Sheet

BRACKET

CROSS-REFERENCE TO RELATED APPLICATIONS

This application claims priority under U.S. law to provisional U.S. patent applications Ser. No. 60/229,623, filed Aug. 31, 2000 and which is incorporated in its entirety by this reference.

FIELD OF THE INVENTION

This invention relates to hardware for connecting wooden members in rigid relation in general, and in particular to an A-frame bracket for securing A-frame members to an overhead beam in playground equipment.

DESCRIPTION OF THE PRIOR ART

Play structures for the entertainment and exercise of children have long been in use. Particularly popular with children has been the swing set which consists of an overhead beam supported on opposite ends by frame members with chairs or seats suspended from the overhead member on chains or ropes. Swing sets or other play structures may be constructed of metal or plastic, but metal is costly and prone to rust, and plastic tends to lack the necessary strength to stand up to heavy use by children. Swing sets may also be constructed from modern weather-resistant treated timber which is strong and durable and does not require painting. Wooden sets present a rugged and attractive appearance and are not subject to rusting.

Because of the bulk and weight of assembled play structures they are rarely shipped from the manufacturer in assembled form, but are often sold as kits for home assembly by the consumer. Because the swing set features the intersection of a number of angled beams, fabrication of swing sets from standard timber lengths without specialized hardware has been restricted to professional carpenters and skilled hobbyists. A play set must be rigidly braced and the structure must be capable of withstanding forces and loads in addition to those due to the swinging motions of the suspended seats.

All-wood playsets have long been known to the art, but wood joinery requires advanced carpentry skill. Previous hardware kits for constructing wooden play sets are also known.

For example, U.S. Pat. No. 4,966,309 to Baer discloses a swing assembly hardware kit. The kit includes 4 brackets for joining together the A-frame to the overhead beam at each end of the swing. The use of multiple brackets in joining the A-frame to the overhead beam leads to several disadvantages. First, the placement of the brackets becomes critical because each bracket must align with the other brackets. In addition, a multi-bracket system lacks the necessary integrity to properly secure the A-frame to the overhead beam. Moreover, as forces are exerted upon the swing set, the connection may loosen due to the multi bracket set-up.

Another example of a bracket system used to join an A-frame to an overhead beam for a swing set can be found in U.S. Pat. No. 5,364,312 to Cunard et al. Cunard discloses a two piece bracket system. The first bracket is a trapezoidal stamped metal plate with side flanges and an outwardly extending top flange. The second bracket is an elongated stamped metal part with an inverted U-shaped cross section formed from a top rectangular surface and two generally triangular side walls (webbing). The bracketing system disclosed in Cunard suffers from the same disadvantages as the bracketing system disclosed in Baer. For example, because the A-frame bracket is formed from two separate pieces, it lacks the stability provided by a one piece system. In using the Cunard bracket, each A-frame member is only secured to a flat flange on the second bracket with the trapezoidal bracket mounted opposite the second bracket, as shown in FIG. 5 of the Cunard patent. However, in this configuration there is no direct connectivity between the two separate brackets thereby resulting in an inferior weak joint in comparison to the one piece bracket design of the present invention. Thus, as the swing set is used over time the brackets forming the joint may become loose from the forces exerted upon the play set by the user. Furthermore, a two piece system also is more difficult to install because the brackets must be properly aligned to gain maximum stability. Finally, the Cunard design provides screw holes that align close to the edges of the members. This configuration may cause the wood members to split or splinter either during installation or during actual use of the play set resulting in a weak unstable connection.

Thus, what is needed is a one piece A-frame bracket that provides maximum stability, has no welded joints, is made from heavy gauge metal and is user friendly.

DETAILED DESCRIPTION

Figure 3:
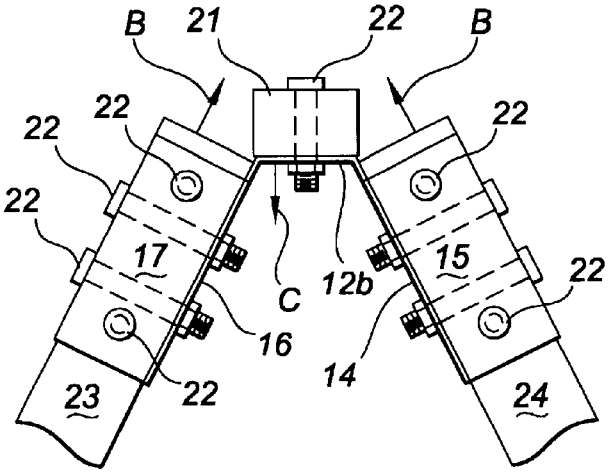
FIG. 3 is an end view of the embodiment in FIG. 2 shown secured to A-frame members and an overhead beam of a play structure.

An A-frame bracket 10 of the present invention is used to secure A-frame members of a swing set to an overhead cross beam as shown in FIG. 3. Bracket 10 is made from a one-piece construction of heavy gauge metal, which contains no welded joints. The unibody is stamp forged and the exterior is completely powder coated and baked at 300 degrees for maximum longevity.

Figure 1:
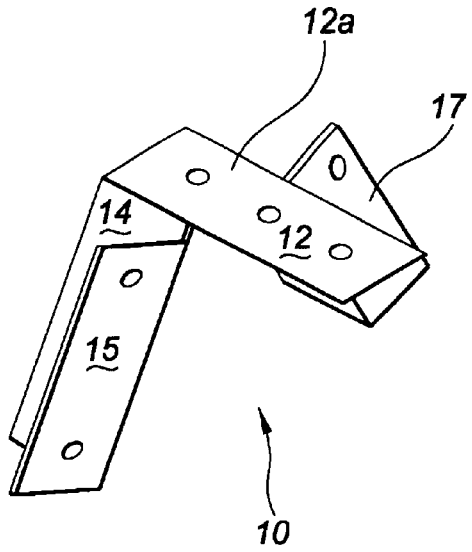
FIG. 1 is a perspective view of a preferred embodiment of the present invention.
Figure 2:
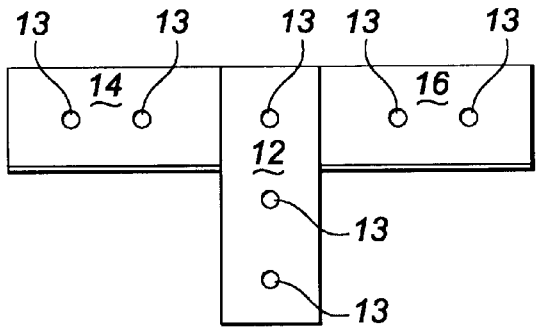
FIG. 2 is a top view of another embodiment of the present invention.

Looking to FIG. 1, bracket 10 has a rectangular top 12, and two rectangular side walls, 14 and 16, that each extend at an angle downwardly from rectangular top 12. The downwardly sloping side walls 14 and 16 each have an integrally formed flange 15 and 17. Flanges 15 and 17 may be of any shape, but in the preferred embodiment, flanges 15 and 17 are rectangular in shape. Top 12, sides 14 and 16 and flanges 15 and 17 each have holes 13 stamped through the metal material for receiving large bolts. The wood members are held in place by drilling matching bolt holes through the wood for receiving the bolts. Since equivalent bolt holes must be placed into the wood members, the placement of the bolt holes in bracket 10 is important, so as not to cause the wood to split. Therefore, bolt holes 13 are centered on bracket 10, so that the corresponding bolt holes in the wood members lie on the center line of the member and not along the edges of a member, as seen in FIGS. 2 and 3.

FIG. 3 discloses how bracket 10 is configured to secure the A-frame members 23 and 24 to overhead beam 21. First, overhead beam 21 is secured to the upper side 12*a* of top 12 using, for example, multiple nut and bolt combinations 22. A-frame members 23 and 24 are then secured within the "L" shape structure formed by side walls 14 and 16 and flanges 15 and 17, respectively, using, for example, several nut and bolt combinations 22. In this configuration, the 4×4 A-frame members can be drawn into the comer of the "L" shaped structure creating a secure stable mounting. This is possible because two sets of nut and bolt combinations are used to secure and draw each A-frame member 23 and 24 in the "L" shaped structure, as shown in FIG. 3.

Additionally, A-frame bracket 10 provides a secure and stable connection by balancing various forces. For example, A-frame members 23 and 24 exert an upward vertical force (shown by arrows B) that opposes a downward vertical force (shown by arrow C). Moreover, because bracket 10 consists of a unibody design, it facilitates a low cost, highly effective device for erecting play systems.

We claim:

1. A bracket for securing a cross beam to frame members comprising:

(a) a top having first and second sides;

(b) a first side wall having first and second sides, the first side wall extending at an angle from the first side of the top;

(c) a second side wall having first and second sides, the second side wall extending at an angle from the second side of the top;

(d) a first flange having first and second sides, the first flange extending at an angle from the first side of the first side wall; and (e) a second flange having first and second sides, the second flange extending at an angle from the first side of the second side wall;

the first side wall and first flange being arranged so as to cradle a frame member between them; and the second side wall and second flange being arranged so as to cradle a frame member between them.

2. The bracket of claim 1, wherein the bracket is formed from a one-piece construction containing no weldments.

3. The bracket of claim 2, wherein the bracket is formed from heavy gauge metal.

4. The bracket of claim 1, wherein the first and second side walls each extend at an angle downwardly from the top.

5. The bracket of claim 1, wherein the first and second sidewalls are in the shape of a rectangle.

6. The bracket of claim 1, wherein the flanges extend perpendicular to the respective side walls.

7. The bracket of claim 1, wherein an end of the first side wall extends from the first side of the top, and wherein the length of the end of the first side wall is less than the length of the first side of the top.

8. The bracket of claim 7, wherein an end of the second side wall extends from the second side of the top, and wherein the length of the end of the second side wall is less than the length of the second side of the top.

9. The bracket of claim 1, wherein the bracket is formed from a one-piece construction containing no weldments, wherein the first and second side walls each extend at an angle downwardly from the top, wherein the first and second sidewalls are in the shape of a rectangle, wherein the flanges extend perpendicular to the respective side walls, wherein an end of the first side wall extends from the first side of the top, wherein the length of the end of the first side wall is less Than the length of the first side of the top, wherein an end of the second side wall extends from the second side of the top, and wherein the length of the end of the second side wall is less than the length of the second side of the top.

10. A play structure comprising:

(a) a cross beam:

(b) a first and second member to support the cross beam (c) a bracket to secure the cross beam and first and second members, the bracket including:

(i) a top having first and second sides;

(ii) a first side wall having fast and second sides, the first side wall extending at an angle from the first side of the top;

(iii) a second side wall having first and second sides, the second side wall extending at an angle from the second side of the top;

(iv) a first flange having first and second sides, the first flange extending at an angle from the first side of the first side wall; and (v) second flange having first and second sides, the second flange extending at an angle from the first side of the second side wall;

the first side wall and first flange being arranged so as to cradle the first member between them; and the second side wall and second flange being arranged so as to cradle the second member between them.

11. The play structure of claim 10, wherein the bracket is formed from a one-piece construction containing no weldments.

12. The play structure of claim 11, wherein the bracket is formed from heavy gauge metal.

13. The play structure of claim 10, wherein the first and second sidewalls each extend at an angle downward from the top.

14. The play structure of claim 10, wherein the first and second side walls are in the shape of a rectangle.

15. The play structure of claim 10, wherein the flanges extend perpendicular to the respective side walls.

16. The play structure of claim 10, wherein the first and second members form an A-frame.

17. The play structure of claim 10, wherein an end of the first side wall extends from the first side of the top, and wherein the length of the end of the first side wall is less than the length of the first side of the top.

18. The play structure of claim 17, wherein an end of the second side wall extends from the second side of the top, and wherein the length of the end of the second side wall is less than the length of the second side of the top.

19. The play structure of claim 10, wherein the bracket is formed from a one-piece construction containing no weldments, wherein the first and second side walls each extend at an angle downwardly from the top, wherein the first and second sidewalls are in the shape of a rectangle, wherein the flanges extend perpendicular to the respective side walls, wherein an end of the first side wall extends from the first side of the top, wherein the length of the end of the first side wall is less than the length of the first side of the top, wherein an end of the second side wall extends from the second side of the top, and wherein the length of the end of the second side wall is less than the length of the second side of the top.

20. A method for constructing a play structure using a one piece bracket comprising the following steps:

(a) providing a one piece bracket including:

(i) a top having an upper surface, and first and second sides;

(ii) a first side wall having first and second sides; the first side wall extending at an angle from the first side of the top;

(iii) a second side wall having first and second sides, the second side wall extending at an angle from the second side of the top;

(iv) a first flange having first and second sides, the first flange extending at an angle from the first side of the first side wall; and (v) a second flange having first and second sides, the second flange extending at an angle from the first side of the second side wall;

(b) securing a cross beam to the upper surface of the top of the bracket;

(c) securing a first member to the first side wall and first flange, the first side wall and first flange being arranged so as to cradle the first member between them; and (d) securing a second member to the second side wall and second flange, the second side wall and second flange being arranged so as to cradle the second member between them.

21. The method of claim 20, wherein the securing of the overhead beam is done using a set of bolts.

22. The play structure of claim 20, wherein the securing of the first and second wooden members is done using a set of bolts.

* * * * *